United States Patent [19]

Kovac et al.

[11] 4,205,484

[45] Jun. 3, 1980

[54] AERODYNAMIC TOY

[76] Inventors: M. Jane Kovac; Peter R. Bloeme, both of 8 Fulton St., Brooklyn, N.Y. 11201

[21] Appl. No.: 907,389

[22] Filed: May 18, 1978

[51] Int. Cl.[2] ..... A63H 27/00

[52] U.S. Cl. ..... 46/74 D

[58] Field of Search ..... 46/74 D, 75; 273/106 B; D34/15 HH, 15 HS; D21/86, 85, 87

[56] References Cited

U.S. PATENT DOCUMENTS

| | | | |
|---|---|---|---|
| D. 241,565 | 9/1976 | Molenaar | D21/86 |
| 3,359,678 | 12/1967 | Headrick | 273/106 B |
| 3,828,466 | 8/1974 | Geiger | 273/106 B |
| 3,855,728 | 12/1974 | Hynds | 46/74 D |

*Primary Examiner*—Louis G. Mancene
*Assistant Examiner*—Michael J. Foycik, Jr.
*Attorney, Agent, or Firm*—Sprung, Felfe, Horn, Lynch & Kramer

[57] ABSTRACT

An aerodynamic toy is provided with a circular central portion having a center surrounded by a substantially flat circular surface, a rim circumscribing the circular central portion terminating in a given plane, a surface of curvature extending from the flat circular surface and curving downwardly to the rim to form an outer convex surface and an inner concave surface and a lip concentric with the rim and extending from the inner concave surface and terminating before the given plane.

8 Claims, 5 Drawing Figures

AERODYNAMIC TOY

BACKGROUND OF THE INVENTION

The present invention relates to an aerodynamic toy of the type which is thrown by the user.

A large number of aerodynamic toys of this type are well known and can be readily seen at recreational sites, such as beaches, parks or school playgrounds. A variety of these devices are disclosed in U.S. Pat. Nos. 2,659,178, 2,835,073, 3,580,580 and 3,590,518.

Toys of this type are usually made of molded plastic discs which are thrown or launched for flight by gripping the disc with the thumb on the convex outer side thereof and with one or more fingers on the concave inner surface of the unit. It is thrown by using an underhand or sidearm motion with a snapping action of the wrist. This causes the disc to spin and the direction of flight is determined by the angle at which the disc is released with respect to the horizontal plane.

U.S. Pat. No. 3,828,466 discloses an aerodynamic device of this type which consists of a plurality of inter boundary rings projecting down from relatively flat plateau upper outer surfaces and which has raised dimples which make for a more comfortable hand grip and better control of the device when thrown.

U.S. Pat. No. 3,855,728 teaches an aerodynamic toy which includes one disc nested within another disc and which are thrown at the same time and which separate during flight so that both land in the same vicinity.

Typical flying disc type devices such as those disclosed in U.S. Pat. Nos. 356,929, 3,359,678 3,724,122 and D 183,626 are designed with a number of circular raised ribs spaced apart on the convex side of the device. These ribs are placed on the device to create turbulence on the convex side which will decrease pressure on that side and create a lifting action. These devices are typically thin in the center section and thicker on the outside rim. Examples of this type are shown in U.S. Pat. Nos. 3,359,678 and 4,045,029. The disadvantage of these rings on the outer surface of the device is that it causes an increase in drag and creates an annoying whistling sound in flight.

SUMMARY OF THE INVENTION

The present invention improves the known aerodynamic toys to improve the handling and the performance thereof.

The invention provides a smooth outer convex surface which has no discontinuities therein to enable the toy to fly upside down when thrown at the proper angle and with sufficient spin and to enable the toy to fly silently.

Further, the present invention provides an inner concentric lip which makes it possible to skip the toy on a hard surface and which concentrates weight distribution at the outer circumference. This allows for an increase in the number of revolutions in flight with the same exertion of force from the snapping wrist action and thus allows the toy to hover in flight longer and fly further.

The inner concentric lip also increases the gripping surface to allow a beginner to control the toy more easily and makes possible various delaying tricks and maneuvers by the insertion of a finger nail or stick within the slot between the outer ring and the inner lip while the toy is revolving.

The toy of the invention can be kicked and tapped by a catcher in a series of flowing movements as a result of the smooth, flat surface on the top and bottom thereof. The overall smooth surface of the toy allows it to fly further with less expenditure of energy due to a decrease in drag.

The present invention provides an aerodynamic toy comprising an integral body having a circular central portion having a center surrounded by a substantially flat circular surface, a rim circumscribing the circular central portion and terminating in a given plane, a surface of curvature extending from the flat circular surface and curving downwardly to the rim to form an outer convex surface and an inner concave surface and a lip concentric with the rim and extending from the inner concave surface and terminating before the given plane.

In a preferred embodiment, the rim has an outer convex surface and the flat circular surface, the surface of curvature and the outer convex surface of the rim are smooth and have no discontinuities in the connections thereof.

In other embodiments, the lip is spaced from the rim a distance effective to prevent the insertion of an adult finger therebetween, and the lip may be either cylindrical in configuration or have an arcuate cross-section with a concave inner surface and a convex outer surface for improved gripping by the user.

In a still further embodiment, the integral body is made of a plastic foam and the lip is spaced from the rim a distance sufficient to permit the insertion of an adult finger therebetween.

The present invention will become apparent to those skilled in the art and will be better understood by reference to the following figures and the following description.

DETAILED DESCRIPTION OF THE INVENTION

Figure 1:
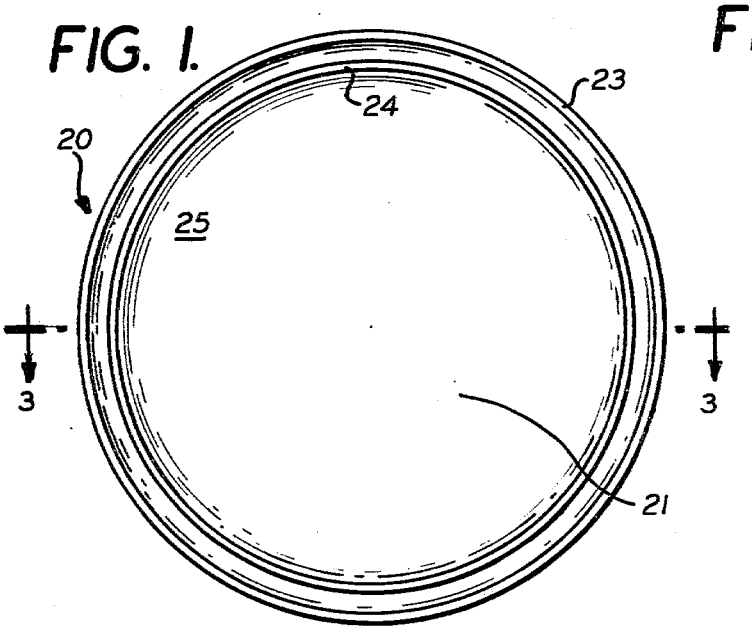
FIG. 1 is a bottom view of one embodiment of the aerodynamic toy of the present invention.
Figure 2:
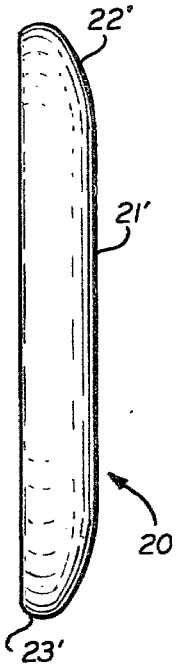
FIG. 2 is a side view of the embodiment of FIG. 1.
Figure 3:
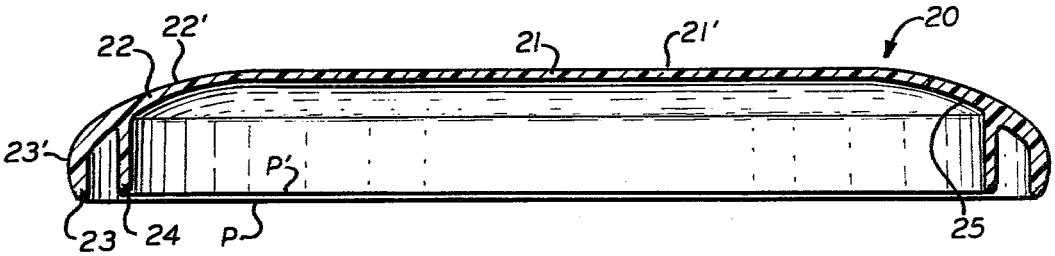
FIG. 3 is a cross-sectional view taken along line III—III of FIG. 1.

Referring now to FIGS. 1–3, the aerodynamic toy comprises a disc-shaped integral body 20 having a circular central portion 21 having a center surrounded by a substantially flat circular outer surface 21'.

The disc-shaped body 20 also includes a rim 23 circumscribing the circular central portion 21 and terminating in a given plane P. The rim 23 has a convex outer surface 23' which has its greatest diameter at a point towards the center thereof to enable the toy to roll at the center of the rim as opposed to the unconnected end thereof.

An intermediate portion 22 connects the circular central portion 21 with the rim 23 and has an outer convex surface 22' and an inner concave surface 25. The outer convex surface 22' curves downwardly to the rim as shown in FIGS. 2 and 3.

As shown in FIGS. 1, 2 and 3, surfaces 21', 22' and 23' are connected to each other with no discontinuities and the curved surfaces 22′ and 23′ form an overall continuous curved surface with no discontinuities. Additionally, it is desirable to have surfaces 21′, 22′ and 23′ to be as smooth as possible and devoid of any surface discontinuities aside from the possible appearance of a line or mark caused during the molding of the integral body.

In order to improve the manipulative gripping and handling of the aerodynamic toy and for containing and retaining buoyant air, lip 24 is provided which is concentric with the rim 23 and extends from the inner concave surface 25 and terminates before the given plane P in a plane P′.

The lip 24, as shown in FIG. 3, is cylindrical in configuration. The lip 24 terminates at plane P′ which is short of the plane P of the rim 23 for comfort and gives the thrower of the toy a far more positive degree of control than previous throwing type toys due to the fact that the thrower is given an inner gripping surface which is a short distance from the rim 23. When one throws the toy, he can hold it at various angles as it is released, when determines the direction of flight of the toy.

In a preferred embodiment of the present invention, as shown in FIG. 3, the lip 24 and rim 23 are spaced apart an effective distance to prevent the insertion of an adult finger therebetween. This spacing should be approximately $\frac{1}{8}$″ to $\frac{3}{8}$″ to enable one to insert one's fingernail or a smooth stick between the rim 23 and lip 24 for so-called delaying tricks and maneuvers.

Figure 4:
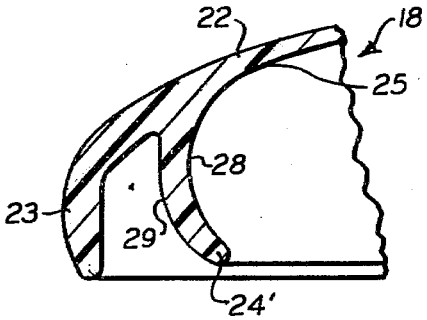
FIG. 4 is a cross-sectional view of the detail of an alternative embodiment of the present invention.

Referring now to FIG. 4, an alternative embodiment is shown which utilizes a curved lip 24′ which has an arcuate cross-section with an inner concave surface and an outer convex surface. Lip 24′ is spaced from rim 23 as in the case of the embodiment of FIG. 3 for a distance effective to prevent the insertion of an adult finger therebetween.

The curved cross-section of lip 24′ provides for an even more positive gripping by the thrower. The lips 24 and 24′ allow the thrower a greater control over the angle at which the aerodynamic toy is released which of course determines the flight path of the toy. Additionally, as a result of the close proximity of lips 24 and 24′ to rim 23, they confine and retain buyoant air and thus increasing the hovering capacity of the toy.

Figure 5:
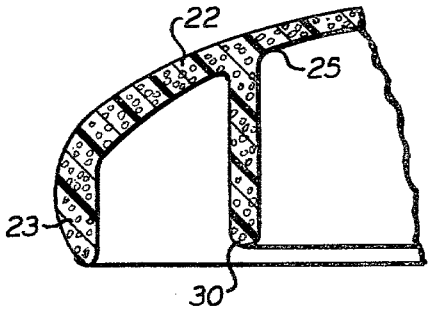
FIG. 5 is a cross-sectional view of a detail of a further embodiment of the present invention.

The integral body 20 is preferably made of a plastic such as a high-density polyethylene or polypropylene plastic. In FIG. 5, another embodiment of the invention is shown wherein the integral body 20 comprises a plastic foam such as foamed polyethylene, polypropylen or polystyrene which will enable the aerodynamic toy to more readily float during use. Additionally, lip 30 is provided which also depends from inner concave surface 25 of intermediate portion 22 of the body, but which is spaced apart from the rim 23 by a distance sufficient to enable the insertion of an adult finger therebetween and which is preferably about $\frac{1}{2}$ to 1″.

While preferred embodiments of the invention ave been described with respect to the drawings, it is to be understood that changes and variations may be made without departing from the spirit or scope of the present invention. For example, those skilled in the art may choose to modify the shapes of the lip or add additional lips to the inner concave surface in order to provide more air pockets.

What is claimed is:

1. An aerodynamic toy comprising an integral body having:
   a. a circular central portion having a center surrounded by a substantially flat circular surface;
   b. a rim circumscribing the circular central portion terminating in a given plane;
   c. a surface of curvature extending from the flat circular surface and curving downwardly to the rim to form an outer convex surface and an inner concave surface; and
   d. a lip concentric with said rim and extending from the inner concave surface and terminating before the given plane.

2. The aerodynamic toy according to claim 1, wherein the lip is spaced from the rim a distance effective to prevent the insertion of an adult finger therebetween.

3. The aerodynamic toy according to claim 2, wherein the lip is cylindrical in configuration.

4. The aerodynamic toy according to claim 2, wherein the lip has an arcuate cross section with a concave inner surface and a convex outer surface.

5. The aerodynamic toy according to claim 1, wherein the integral body comprises a foam and the lip is spaced from the rim a distance sufficient to permit the insertion of an adult finger therebetween and wherein the lip is cylindrical in configuration.

6. The aerodynamic toy according to claim 1, wherein the rim has an outer convex surface and wherein the flat circular surface, the surface of curvature and outer convex surface of the rim are smooth.

7. The aerodynamic toy according to claim 1, wherein the rim has an outer convex surface and wherein the connections of the outer convex surface of the rim, the flat circular surface and the surface of curvature have no discontinuities.

8. The aerodynamic toy according to claim 6, wherein the rim has an outer convex surface and wherein the connections of the outer convex surface of the rim, the flat circular surface and the surface of curvature have no discontinuities.

* * * * *